United States Patent [19]

Bogert

[11] 4,000,838

[45] Jan. 4, 1977

[54] SPOUT FORMING MEANS FOR CONTAINERS

[76] Inventor: Clayton Bogert, 118 Lowell Road, Glen Rock, N.J. 07452

[22] Filed: June 11, 1975

[21] Appl. No.: 585,932

Related U.S. Application Data

[63] Continuation of Ser. No. 293,355, Sept. 29, 1972, abandoned.

[52] U.S. Cl. ..... 222/529; 222/541

[51] Int. Cl.[2] ..... B67D 5/12

[58] Field of Search ..... 229/7 R; 222/528, 529, 222/535, 541

[56] References Cited

UNITED STATES PATENTS

| | | | |
|---|---|---|---|
| 3,154,226 | 10/1964 | Petitto | 222/528 |
| 3,292,839 | 12/1966 | Pike | 229/7 |
| 3,473,705 | 10/1969 | May et al. | 222/541 |
| 3,481,515 | 12/1969 | Booth et al. | 222/529 |

*Primary Examiner*—Allen N. Knowles
*Assistant Examiner*—Norman L. Stack, Jr.
*Attorney, Agent, or Firm*—Arthur A. March

[57] ABSTRACT

Container with pull-tab opener and score line opening area type lid, having a fan-folded member within the container and secured at its edge portions to the underside of the lid in the opening area marginal portions and at its central portion to the underside of the lid in the corresponding central pull-tab opening area and being freely disposed in corresponding fold portions disposed between its edge portions and central portion and folded to a collected position substantially adjacent to the lid, whereby when the tab opener is lifted to provide the lid opening, the attendant displaceable portions of the fan-folded flexible member are outwardly drawn therewith to form a pouring spout for the container.

7 Claims, 7 Drawing Figures

SPOUT FORMING MEANS FOR CONTAINERS

This is a continuation of application Ser. No. 293,355 filed on Sept. 29, 1972, now abandoned.

THE BACKGROUND OF THE INVENTION

This invention relates to means for providing a spout from which to pour the contents of a container when it is opened.

Heretofore when containers or cans such as those made of metal are opened with the use of a conventional can opener or by means of the well-known integral pull tab opener it has often been found to be very difficult to pour the contents in a desired direction or to a desired place. This is particularly true when using containers whose contents are drained in a single use, as for example cans containing oil for use in vehicles, additives for gasoline, household chemicals, large cans for juices, and so forth. As a consequence in certain instances containers provided with restricted neck portions are provided or cumbersome openers which pierce the top of the can and have elongate spouts are used.

The restricted neck containers require the use in manufacture of costly and expensive shaping dies or molds and need separate cap closures. The piercing openers are separate pieces which require manual dexterity for efficient operation and must be removed and stored when the can is discarded. The pull tab openers currently in use are not provided with means for directing the flow of the contents of the container.

SUMMARY OF THE OBJECTS AND FEATURES OF THIS INVENTION.

An object of the present invention is to provide a container with a spout which is formed as the container is opened.

Another object of the invention is to provide a container with an integral spout which is relatively inexpensive to produce and simple to operate without requiring a special manual dexterity.

Still another object of the invention is to provide spout forming means for a container having a pull tab opener which is erected into a spout as the container is opened.

A feature of the invention is the provision of a spout for containers having a pull tab opening which does not disturb or alter the container or the existing fundamental pull tab structure.

Another feature of the invention is the provision of a spout for a container which does not alter the amount of contents in the container.

Still another feature of the invention is the provision of a spout integral with a container which does not effect the integrity of the contents in the container.

An advantage of the invention is the provision of a spout integral with a conventional container which may be supplied without changing the size, shape or structure of the container.

Another advantage of the invention is the provision of a spout for a container which may be discarded with the container after the contents are drained.

Other objects, features and advantages are set forth in the accompanying specification and drawings which, it will be understood, are only illustrative of the invention and not intended to limit its scope.

SPECIFICATION OF THE INVENTION

Figure 1:
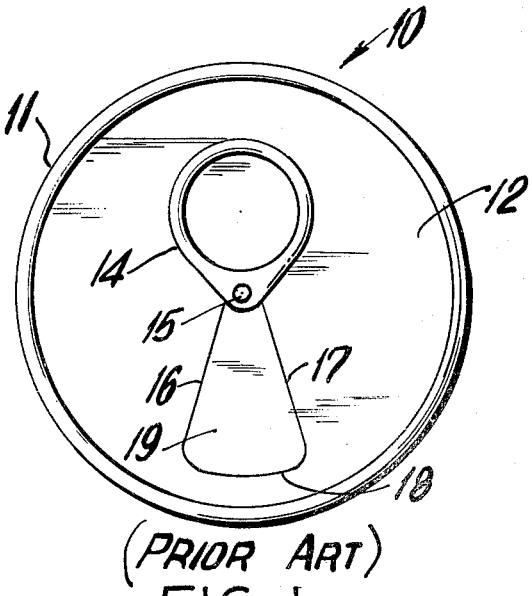
(PRIOR ART) FIG. 1
FIG. 1 is a top plan view of a conventional container with a lid having a pull tab opener.

As shown in the drawings, the container 10 comprises a body portion 11 and a lid portion 12 which is usually secured to the body after the container is filled. To illustrate the invention, without in any way limiting the same to specific details, the lid shown is provided with a conventional pull tab for opening the container. The pull tab per se construction is known in the art and comprises a ring 14 riveted at 15 to the lid. The lid is weakened or scored along lines 16 and 17 which extend from the rivet to another weakened or scored portion of the lid along line 18. Of course the specific location of the weakened lines may vary within the operational limits and it is possible to dispense with weakened line 18 in certain instances.

The conventional operation of the pull tab opener is such that initially the ring is lifted to break the securement by the rivet 15. Continued movement of the ring upwardly and in the direction of the weakened lines 16 and 17 causes the material to rupture along these lines forming a tab or flap 19 which is then discarded. The contents are poured from the container through the opening which remains in the lid.

However, it is extremely difficult, if not impossible to direct the flow of the contents through this opening to narrow, remote or relatively inaccessible places without substantial loss or spillage of the contents. As a result containers of this type while quite popular have very little use in the vast field where directed flow is required. The present invention resolves such difficulties with an integral, novel spout forming means.

Figure 2:
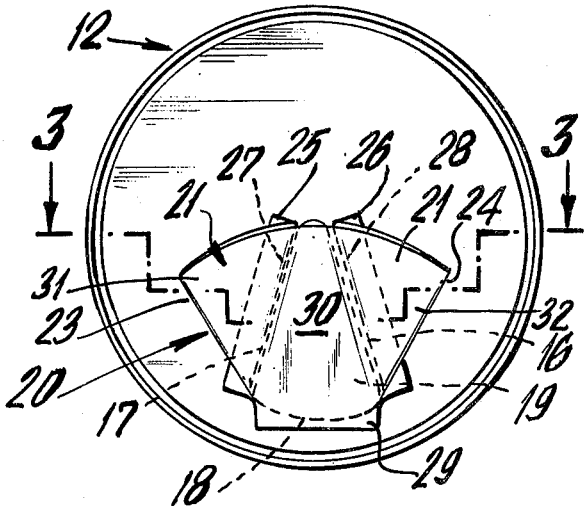
FIG. 2 is a plan view of the underside of the container lid showing the spout forming means of the present invention prior to opening.
Figure 3:
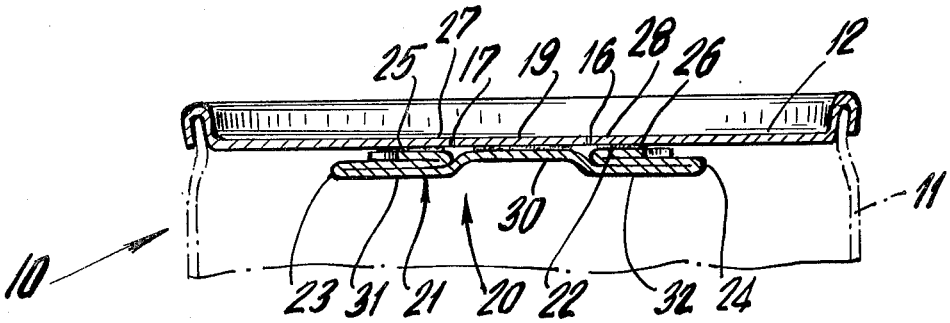
FIG. 3 is a sectional view taken along the lines 3—3 of FIG. 2.
Figure 4:
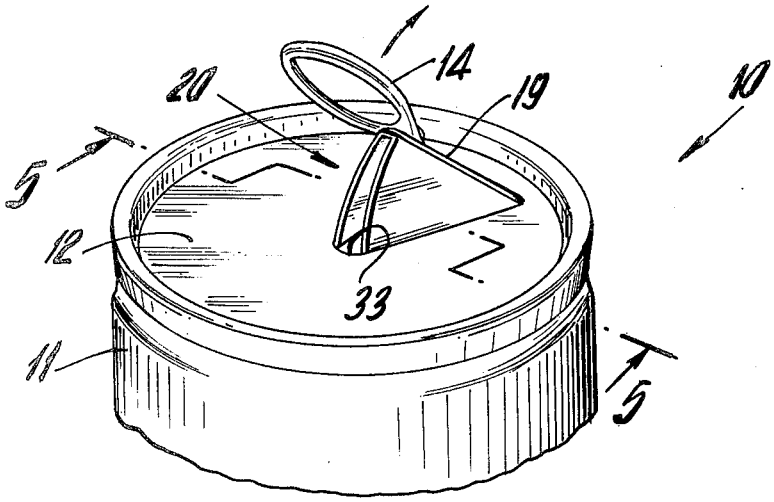
FIG. 4 is a perspective view of a container showing the spout being formed as the pull tab is lifted.
Figure 5:
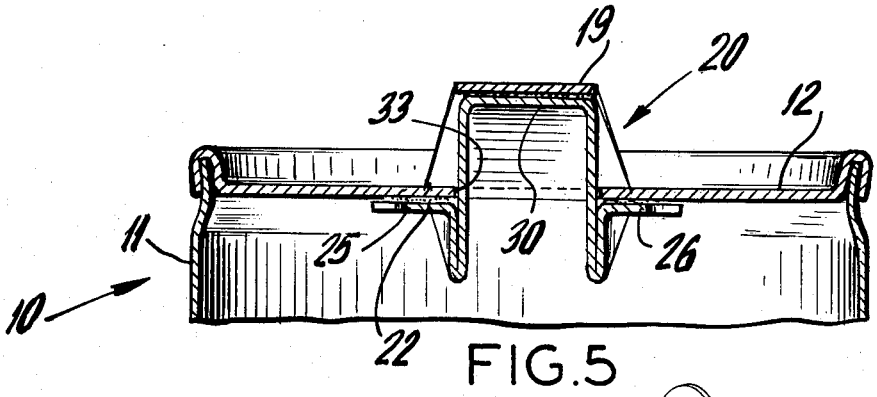
FIG. 5 is a sectional view taken along the lines 5—5 of FIG. 4.
Figure 6:
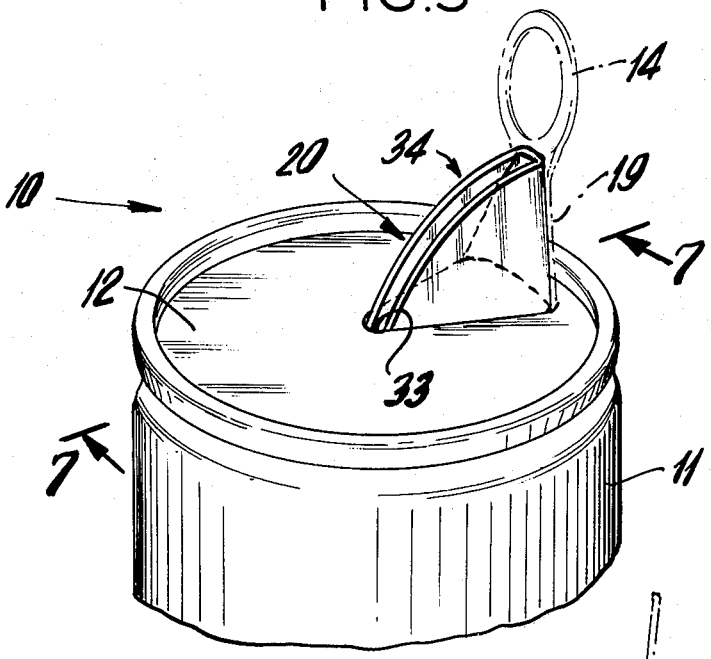
FIG. 6 is a perspective view of a container showing the spout of this invention completely formed when the pull tab is fully lifted.
Figure 7:
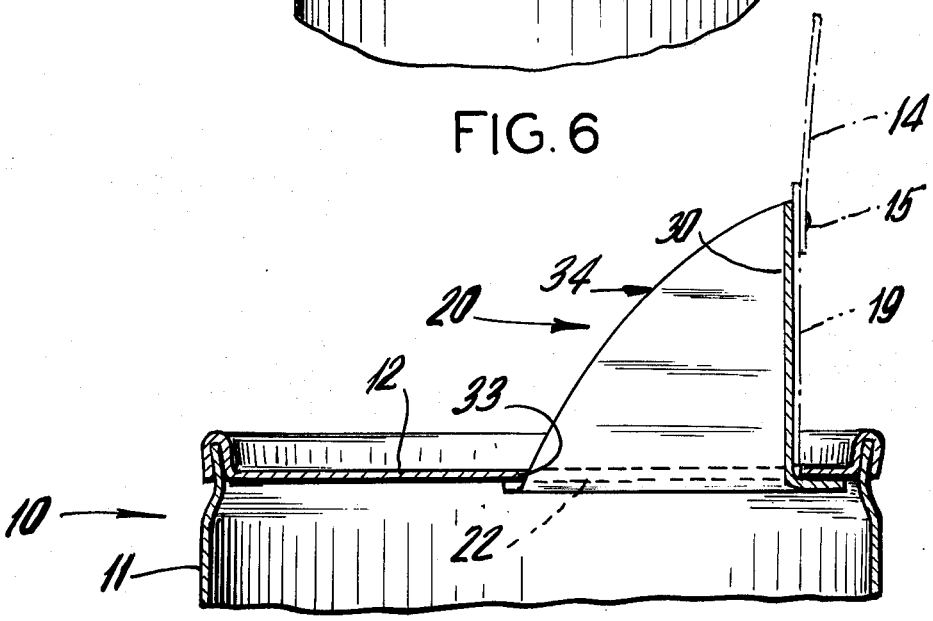
FIG. 7 is a sectional view taken along the lines 7—7 of FIG. 6.

According to the present invention the underside of the lid as shown in FIGS. 2 and 3 is provided with spout forming means 20 which is preferably flexible but nevertheless able to maintain a formed shape without deformation by pressures exerted in pouring the contents from the container. It has been found that the metal foils such as aluminum or tin are adapted for this purpose although, of course, any suitable material which satisfies the aforesaid requirements may be used.

As shown the spout forming means comprises a formed or shaped piece of flexible material 21 of a size at least sufficient to cover the tab or flap 19 and that portion 22 of the underside of the lid which is adjacent to the tab between the weakened lines 16, 17 and 18 as well as the areas immediately adjacent thereto. The flexible material 21 as shown is preferably fan-folded upon itself along its sides or outer edges 23 and 24. The portions 25 and 26 of the fan-folded material are secured by any suitable adhesive to the edges 27, 28 and 29 of the weakened or scored lines 16, 17 and 18. The central segment 30 of the shaped piece 21 is secured to the under side of the tab or flap 19. The wing portions 31 and 32 of the shaped piece 21 remain free and unsecured although preferably flattened as shown, to prevent their extending into the container itself.

Thus the spout forming means of the present invention consume little if any space in the container and do not disturb or interfere with the contents thereof. It may be seen that these means are inexpensive, safe and easy to assemble and attach to the container lid.

When the can is to be opened as above described by lifting the ring 14 the tab or flap 19 is pulled away and pulls with it the central segment 30 of the shaped spout forming means 20. As this is accomplished the wings 31 and 32 are unfolded following the central segment through the aperture 33 formed in the lid 12 and provide a full spout 34 for pouring the contents of the container as shown in FIGS. 4 through 7. It is thus possible to direct the flow of the contents to any desired position or place in a confined stream. If desired the ring 14 may be easily displaced or removed by simple manipulation to avoid any interference with the stream of flow of the product.

As a result the invention provides a spout which is integral with the can itself, which is reliable and economic and one which is automatically erected as the container is opened.

While the invention has been described in detail in the foregoing specification to facilitate an understanding thereof, it is understood that the description and the illustration in the drawings are in no way intended to limit its scope. Variations and modifications may be made to the invention without departing from the scope of the appended claims.

I claim:

1. Container having a substantially rigid lid secured to its walls, weakened scoring lines formed in a portion of the lid and defining an opening area, a tab opener disposed inwardly of the edge of the container and secured to the lid within the bounds of the scoring lines to form a lid opening when the tab opener is lifted, and a substantially fan-folded flexible member disposed within the container and having corresponding lateral edges and a leading edge, and secured at its lateral edges to the underside of the lid outwardly adjacent to the bounds of the scoring lines and secured at its central portion to the underside of the lid within the bounds of the scoring lines, and having substantially freely disposed fold portions between each of its lateral edges and the central portion, the fold portions being folded in substantially adjacent to the lid, and its leading edge being substantially crosswise between its lateral edges and along the corresponding fold portions thereat to define a spout rim portion, whereby when the tab opener is lifted to provide the lid opening, the central portion, leading edge and fold portions of the fan-folded flexible member are outwardly drawn therewith and through such opening to form a spout to facilitate the pouring of the contents from the container.

2. Container according to claim 1 wherein the fan-folded flexible member is provided with a fixedly disposed spout base hinge-defining edge opposite to the spout rim defining leading edge and correspondingly extending crosswise between its lateral edges and secured to the underside of the lid outwardly adjacent to the bounds of the scoring lines.

3. Container according to claim 2 wherein the opening area in the portion of the lid defined by the scoring lines includes a base hinge portion free from scoring lines and serving as fulcrum for the tab opener and overlying the spout base hinge-defining edge of the fan-folded flexible member.

4. Container according to claim 2 wherein the fan-folded flexible member is secured at its side edges to the underside of the lid substantially throughout the marginal portions of the opening area defined by the scoring lines.

5. Container according to claim 3 wherein the fan-folded flexible member is secured at its said edges to the underside of the lid substantially throughout the marginal portions of the opening area defined by the scoring lines.

6. Container according to claim 2 wherein the fan-folded flexible member is formed of foil material.

7. Container according to claim 6 wherein the foil material is metal foil.

* * * * *